US008434601B2

(12) United States Patent
Hou et al.

(10) Patent No.: US 8,434,601 B2
(45) Date of Patent: May 7, 2013

(54) CARRYING CASE

(75) Inventors: Hong-Qi Hou, Shenzhen (CN); Ming-Chang Lee, Taipei Hsien (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 424 days.

(21) Appl. No.: 12/820,322

(22) Filed: Jun. 22, 2010

(65) Prior Publication Data

US 2011/0227463 A1 Sep. 22, 2011

(30) Foreign Application Priority Data

Mar. 16, 2010 (CN) ..... 099107529

(51) Int. Cl.
*A45C 9/00* (2006.01)

(52) U.S. Cl.
USPC ..... 190/1; 150/119; 248/455; 248/459; 206/760; 206/320

(58) Field of Classification Search ..... 190/902, 190/1; 206/305, 320, 760; 361/679.55, 679.59; 383/4; 248/455; 150/119
See application file for complete search history.

(56) References Cited

U.S. PATENT DOCUMENTS

| | | | | | |
|---|---|---|---|---|---|
| 4,318,471 | A * | 3/1982 | Hutton | 206/214 |
| 4,643,281 | A * | 2/1987 | Erickson | 190/119 |
| 5,377,794 | A * | 1/1995 | Book | 190/1 |
| 5,607,054 | A * | 3/1997 | Hollingsworth | 206/320 |
| 5,722,628 | A * | 3/1998 | Menaged | 248/441.1 |
| 5,887,723 | A * | 3/1999 | Myles et al. | 206/760 |
| 7,545,634 | B2 * | 6/2009 | Simonian et al. | 361/679.55 |
| 2004/0134812 | A1 * | 7/2004 | Yeh | 206/320 |

FOREIGN PATENT DOCUMENTS

| | | | |
|---|---|---|---|
| CN | 2696277 | Y | 4/2005 |
| CN | 201167654 | Y | 12/2008 |

* cited by examiner

*Primary Examiner* — Tri Mai
(74) *Attorney, Agent, or Firm* — Altis Law Group, Inc.

(57) ABSTRACT

A carrying case for an electronic device includes a main compartment receiving the electronic device and having an opening as an entrance, a cover foldably fixed on the main compartment for covering the opening, a first supporting member positioned on the cover and a second supporting member positioned on the cover and spaced from the first supporting member, a first engaging member and a first fixing member. The first supporting member and the second supporting member are capable of forming a V-shaped ridge structure when the cover is partially elevated above the main compartment and supporting the electronic device. The first engaging member is fixed on the first fixing member to maintain the V-shaped ridge structure.

10 Claims, 4 Drawing Sheets

CARRYING CASE

BACKGROUND

1. Technical Field

The present disclosure relates to device accessories and, particularly, to a carrying case for an electronic device.

2. Description of the Related Art

A frequently used carrying case for an electronic device includes a main compartment receiving the electronic device and a cover moveably positioned on the main compartment. When the electronic device is received in the main compartment, the cover can be fastened to the main compartment to prevent the electronic device from dropping out. The cover also can be released from the main compartment to take the electronic device out of the main compartment for using the electronic device.

However, an additional support structure is required; this structure is placed under the electronic device, to adjust a viewing angle thereof, compromising convenience of transport.

Therefore, there is room for improvement within the art.

BRIEF DESCRIPTION OF THE DRAWINGS

The components in the drawings are not necessarily drawn to scale, the emphasis instead placed upon clearly illustrating the principles of the present disclosure. Moreover, in the drawings, like reference numerals designate corresponding parts throughout the views, and both the views are schematic.

DETAILED DESCRIPTION

Figure 1:
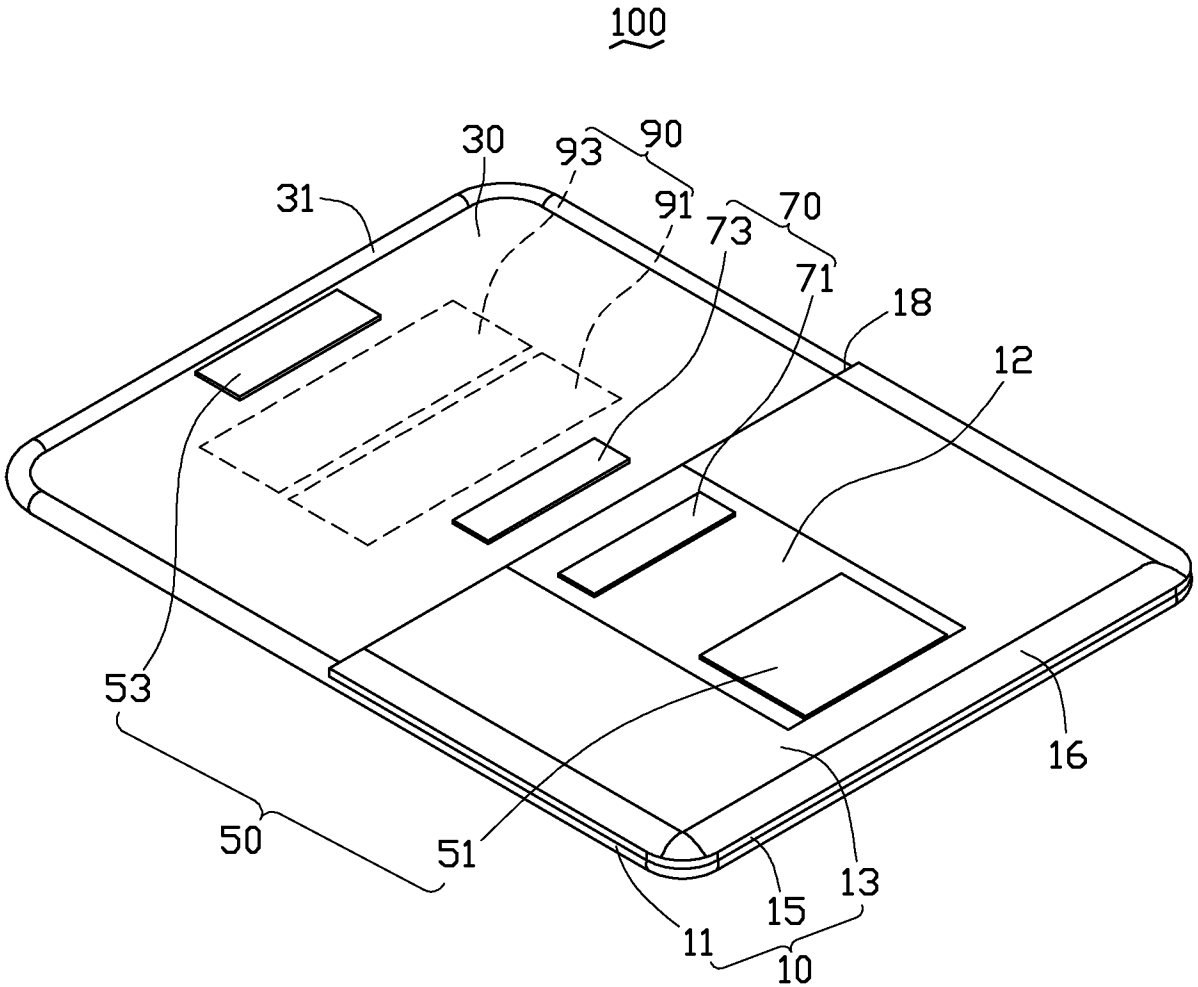
FIG. 1 is an isometric view of an embodiment of a carrying case.
Figure 2:
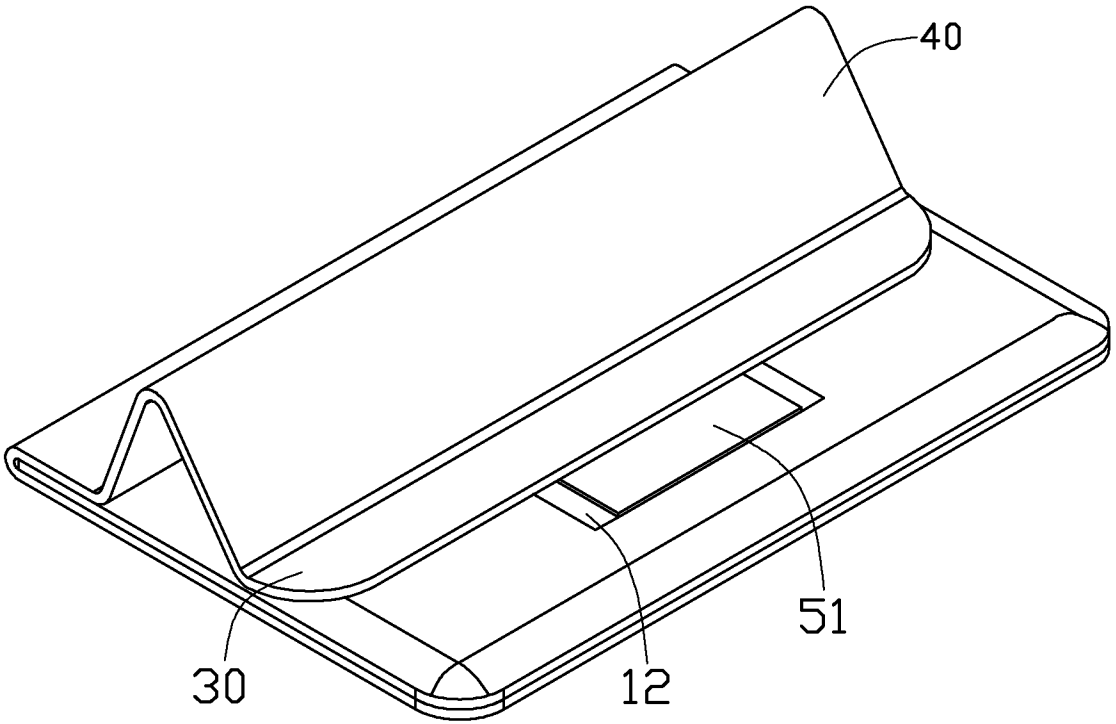
FIG. 2 shows a first state of the carrying case shown in FIG. 1.
Figure 3:
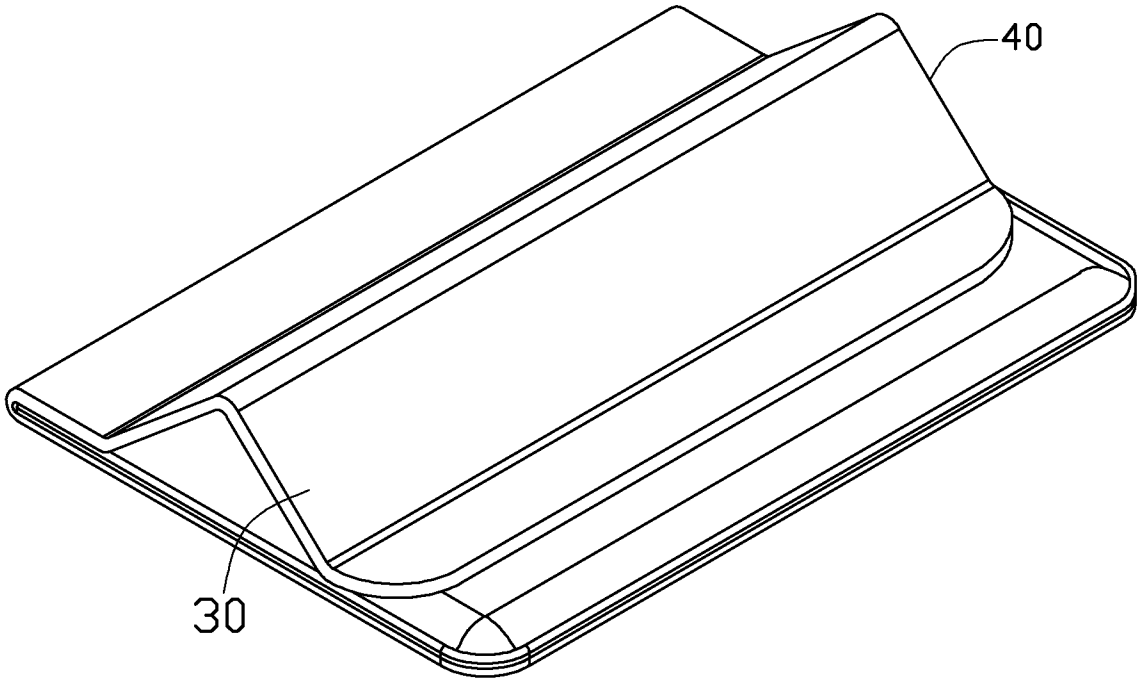
FIG. 3 shows a second state of the carrying case shown in FIG. 1.
Figure 4:
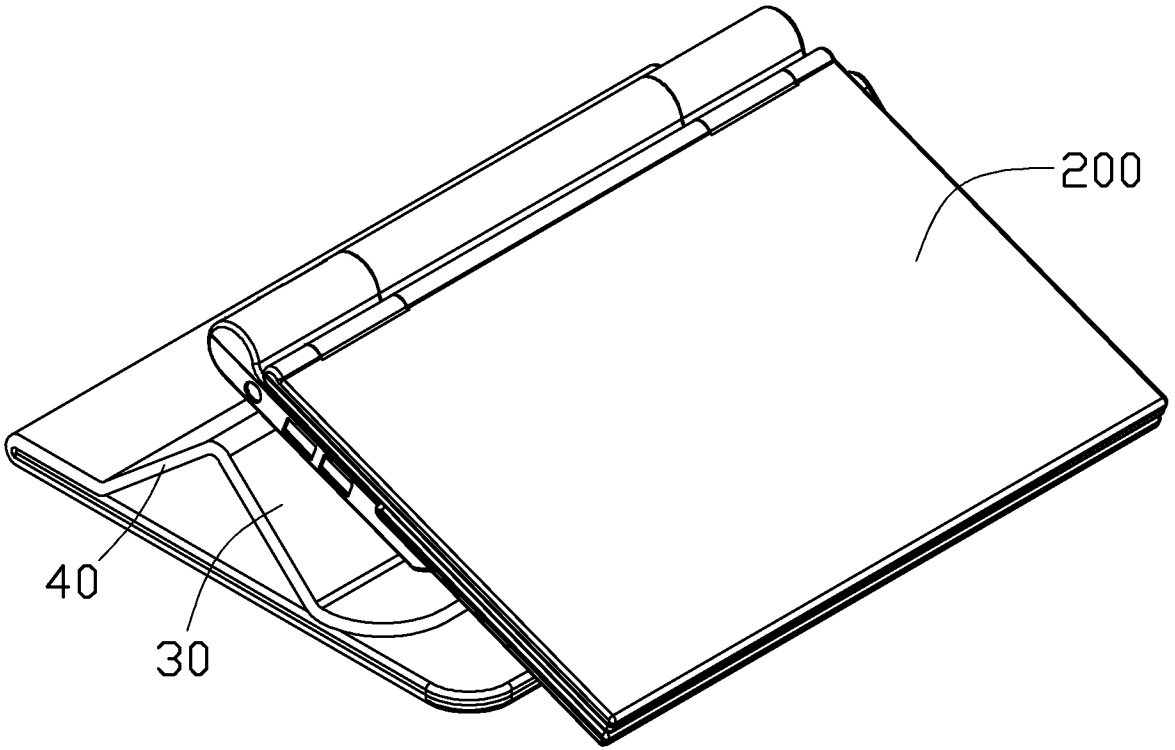
FIG. 4 is isometric view of an electronic device positioned on the carrying case in the first state shown in FIG. 2.

Referring to FIGS. 1 through 3, an embodiment of a carrying case 100 includes a main compartment 10, a cover 30 moveably positioned at a side of the main compartment 10, a first fastening assembly 50, a second fastening assembly 70 and supporting assembly 90. The carrying case 100 is used for carrying or supporting an electronic device 200 (FIG. 4), such as a notebook computer, projector or digital video disc player. In the illustrated embodiment, the electronic device 200 is a notebook computer.

The main compartment 10 is substantially rectangular. The main compartment 10 includes a bottom surface 11 and a top surface 13 opposite to the bottom surface 11 and interconnected thereto by three sidewalls 15. The bottom surface 11, the top surface 13 and two sidewalls 15 cooperatively define an entrance 18. The main compartment 10 forms a flexible frame 16 at edges on the top surface 13. The main compartment 10 further includes a reinforcement member 12 on an outer surface of the top surface 13. In alternative embodiment, the reinforcement member 12 may be in the top surface 13.

The cover 30 extends from the bottom surface 11, and is capable of being folded over the top surface 13 to cover the entrance 18. The cover 30 is substantially rectangular, made of soft material, and includes a flexible frame 31 formed at edges of the cover 30.

The first fastening assembly 50 includes a first fixing member 51 and a first engaging member 53. The first fixing member 51 and the first engaging member 53 are substantially rectangular, and the first fixing member 51 has an area exceeding that of the engaging member 53, such that the engaging member 53 can be detachably fastened at different positions of the first fixing member 51 to fix the cover 30 on the main compartment 10 to cover the opening 18. The engaging member 53 can be fastened at an end of the first fixing member 51 adjacent to the opening 18, such that part of the cover 30 is elevated above the top surface 13, and also at a second position at an end of the first fixing member 51 away from the opening 18 to unfold the cover 30. In the illustrated embodiment, the engaging member 53 and the first fixing member 51 are hook and loop closure components. Alternatively, the first fixing member 51 and the engaging member 53 may be a pair of magnets of opposing polarity, or one of the first fixing member 51 and the engaging member 53 can be a magnet, and the other of a magnetically attractive material.

The second fastening assembly 70 includes a second fixing member 71 and a second engaging member 73. The second engaging member 71 is positioned at a side of the reinforcement member 12 adjacent to the opening 18 and spaced from the first fixing member 51. The second engaging member 73 is fixed at an end portion of the cover 30 adjacent to the opening 18 of the main compartment 10. The second fixing member 71 is fixed on the second engaging member 73 when the first fixing member 51 is fixed on the second fixing member 73, to ensure the opening 18 is covered.

As shown in FIGS. 1 through 4, supporting assembly 90 includes a first supporting member 91 and a rectangular second supporting member 93 adjacent to the first supporting member 91. In the illustrated embodiment, the first supporting member 91 and the second supporting member 93 are substantially rectangular and of rigid material, such as plastic or metal. The first supporting member 91 and the second supporting member are between the second fixing member 53 and the second engaging member 73. The first supporting member 91 is adjacent to the second engaging member 73; the second supporting member 93 is adjacent to the second fixing member 53. When the cover 30 is used as a support, the first supporting member 91 and the second supporting member 93 form a V-shaped ridge structure 40, cooperatively supporting the electronic device 200 (shown in FIG. 4). The ridge structure 40 can be raised by moving the fastening position of the first fixing member 51 toward the opening 18. In the illustrated embodiment, the first and the second supporting members 91, 93 are positioned in the cover 30. In the alternative embodiment, the first and the second supporting member 91, 93 may be positioned at a surface of the cover 30.

When the electronic device 200 is received in the main compartment 10 from the opening 18, the first fixing member 53 and the second fixing member 73 are fastened to the second fixing member 51 and the second engaging member 71 respectively, to cover the main compartment 10 and retain the electronic device 200 in the main compartment 10.

When the electronic device 200 is taken out for use, the cover 30 can be elevated, and the first supporting member 91 and the second supporting member 93 form the ridge structure 40 supporting the electronic device 200. The first fixing member 51 is fixed on the first engaging member 53 to sustain the ridge structure 40. The second fixing member 71 is fixed on the second engaging member 73 to ensure the opening 18 is covered. An end of the electronic device 200 is positioned on the ridge structure 40, such that the electronic device 200 is inclined relative to the user. The height of the ridge structure 40 can be adjusted by changing the contact point of the first fixing member 51 and the first fixing member 53, allowing a full range of viewing angles. The reinforcement member 12 enhances the integrity of the main compartment 10, preventing deformity thereof. The flexible frame 16 resists the electronic device 200 to prevent relative movement thereof in the main compartment 10.

Finally, while particular embodiments have been described, the description is illustrative and is not to be construed as limiting. For example, various modifications can be made to the embodiments by those of ordinary skill in the art without departing from the true spirit and scope of the invention as defined by the appended claims.

What is claimed is:

1. A carrying case for an electronic device comprising:

a main compartment receiving the electronic device, the main compartment comprising an entrance;

a foldable cover fixed on the main compartment for covering the entrance;

a first supporting member positioned on the cover and a second supporting member positioned on the cover and spaced from the first supporting member; the first supporting member and the second supporting member capable of forming a V-shaped ridge structure when the cover is partially elevated above the main compartment, the V-shaped ridge structure supporting the electronic device;

a first engaging member and a first fixing member fixed on the first engaging member to maintain the V-shaped ridge structure;

a reinforcement member positioned on the main compartment, wherein the first engaging members are positioned on the reinforcement member.

2. The carrying case of claim 1, wherein an area of the first fixing member exceeds that of the first engaging member.

3. The carrying case of claim 1, wherein the first fixing member and the first engaging member comprise hook and loop closure elements.

4. The carrying case of claim 1, further comprising a second fixing member positioned on the main compartment adjacent to the entrance and a second engaging member positioned on the cover adjacent to the entrance; the first engaging member detachably fixed on the first fixing member.

5. The carrying case of claim 4, wherein the first engaging member and the second engaging member comprise hook and loop closure elements.

6. The carrying case of claim 4, wherein the second engaging members are positioned on the reinforcement member.

7. The carrying case of claim 6, wherein the main compartment further comprises a top surface, a bottom surface and three sidewalls interconnecting the top surface and the bottom surface, wherein the entrance is cooperatively defined by the top surface, the bottom surface and sidewalls; the reinforcement member is positioned on the top surface, and the cover extends from the bottom surface.

8. The carrying case of claim 7, wherein the main compartment further comprises a flexible frame formed at an edge on the top surface.

9. The carrying case of claim 1, the cover further comprising a flexible frame formed at an edge thereof.

10. A carrying case for an electronic device comprising:

a main compartment receiving the electronic device, the main compartment comprising an entrance;

a foldable cover fixed on the main compartment for covering the entrance;

a first supporting member positioned on the cover and a second supporting member positioned on the cover and spaced from the first supporting member; the first supporting member and the second supporting member capable of forming a V-shaped ridge structure when the cover is partially elevated above the main compartment, the V-shaped ridge structure supporting the electronic device;

a first engaging member and a first fixing member fixed on the first engaging member to maintain the V-shaped ridge structure;

a second fixing member positioned on the main compartment adjacent to the entrance and a second engaging member positioned on the cover adjacent to the entrance, the first engaging member detachably fixed on the first fixing member; and a reinforcement member positioned on the main compartment, wherein the first and second engaging members are positioned on the reinforcement member.

* * * * *